US010711414B2

(12) United States Patent
Verhaelen et al.

(10) Patent No.: US 10,711,414 B2
(45) Date of Patent: Jul. 14, 2020

(54) EARTH WORKING MACHINE HAVING A CONVEYING DEVICE QUICKLY DISTANCEABLE FROM THE MILLING UNIT, AND METHOD THEREFOR

(71) Applicant: Wirtgen GmbH, Windhagen (DE)

(72) Inventors: Philip Verhaelen, Köln (DE); Andreas Salz, Neustadt (DE)

(73) Assignee: Wirtgen GmbH (DE)

( * ) Notice: Subject to any disclaimer, the term of this patent is extended or adjusted under 35 U.S.C. 154(b) by 0 days.

(21) Appl. No.: 16/520,733

(22) Filed: Jul. 24, 2019

(65) Prior Publication Data

US 2020/0063385 A1 Feb. 27, 2020

(30) Foreign Application Priority Data

Aug. 21, 2018 (DE) ..... 10 2018 214 133

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/12
(Continued)

(56) References Cited

U.S. PATENT DOCUMENTS 3,946,506 A * 3/1976 Snow, Jr. ..... E01C 19/004 37/382
4,186,968 A * 2/1980 Barton ..... B28D 1/18 299/39.2

(Continued)

FOREIGN PATENT DOCUMENTS

DE 202009003824 U1 9/2010
DE 102014011878 A1 2/2016
WO 9859114 A1 12/1998

OTHER PUBLICATIONS

European Patent Office search report for corresponding patent No. 19192242.6, dated Jan. 13, 2020, 8 pages (not prior art).

*Primary Examiner* — Sunil Singh
(74) *Attorney, Agent, or Firm* — Lucian Wayne Beavers; Patterson Intellectual Property Law, PC

(57) ABSTRACT

The present invention relates to an earth working machine (10) having a machine frame (12);

a milling unit (26) that is carried on the machine frame (12) and encompasses a milling tool (28) and a milling tool housing (30) that shields the milling tool (28) with respect to the external environment of the earth working machine (10); and a receiving conveying device (36);

the receiving conveying device (36), both in an operationally ready operating state and in a non-operationally-ready installation state, being mounted on the earth working machine (10) movably relative to the machine frame (12);

such that in the operational state of the receiving conveying device (36), a portion of the receiving conveying device (36) which is located closer to the milling tool (28) is coupled by means of a first motion coupling (53) for motion together with a part (52) of the milling tool housing (30) which is movable relative to the machine frame (12);

such that in order to establish the installation state, the first motion coupling (53) is disengageable, and that portion (**36*a*) of the receiving conveying device (36) which is located closer to the milling tool (28) is swingably suspendable on the machine frame (12**).

Provision is made according to the present invention that the receiving conveying device (36), in addition to swingable (Continued)

suspension (56) on the machine frame (12), is couplable by means of a second motion coupling (58), different from the first (53), to a component arrangement (24, 46) of the earth working machine (10) which is drivable to move relative to the machine frame (12), in such a way that a driven motion of the component arrangement (24, 46), from an initial position into a final position different therefrom, brings about a displacement of the swingably suspended receiving conveying device (36) away from the milling unit (26).

25 Claims, 6 Drawing Sheets

(58) Field of Classification Search
USPC ..... 404/90–94; 299/39.1, 39.2, 39.4
See application file for complete search history.

(56) References Cited

U.S. PATENT DOCUMENTS

| | | | | |
|---|---|---|---|---|
| 6,296,318 | B1 | 10/2001 | Simons et al. | |
| 6,457,779 | B1 * | 10/2002 | Busley | E01C 23/088 299/39.2 |
| 2013/0187437 | A1 | 7/2013 | Von Schönebeck et al. | |
| 2013/0234495 | A1 * | 9/2013 | Miller | E01C 23/127 299/39.1 |
| 2017/0130407 | A1 * | 5/2017 | Laux | B62D 65/02 |
| 2017/0174421 | A1 * | 6/2017 | Schomaker | B65D 88/129 |
| 2017/0174422 | A1 * | 6/2017 | Schomaker | B60P 1/54 |

* cited by examiner

EARTH WORKING MACHINE HAVING A CONVEYING DEVICE QUICKLY DISTANCEABLE FROM THE MILLING UNIT, AND METHOD THEREFOR

BACKGROUND

The present invention relates to an earth working machine, for example a road milling machine or a surface miner, having a machine frame;

a milling unit that is carried on the machine frame and encompasses a milling tool and a milling tool housing that shields the milling tool with respect to the external environment of the earth working machine; and a receiving conveying device that is operationally embodied to convey earth material, removed by the milling tool, away from the milling unit, the receiving conveying device, both in an operationally ready operating state and in a non-operationally-ready installation state, being mounted on the earth working machine movably relative to the machine frame, such that in the operational state of the receiving conveying device, a portion of the receiving conveying device which is located closer to the milling tool is coupled by means of a first motion coupling for motion together with a part of the milling tool housing which is movable relative to the machine frame; and such that in order to establish the installation state, the first motion coupling is disengageable, and that portion of the receiving conveying device which is located closer to the milling tool is swingably suspendable on the machine frame.

The present invention furthermore relates to a method for temporarily distancing a receiving conveying device from a milling unit of a substrate-removing earth working machine, in particular a road milling machine or a surface miner, that is operationally ready at the beginning of the method, the milling unit encompassing a milling tool and a milling tool housing that shields the milling tool, the receiving conveying device conveying substrate material, removed during milling operation of the earth working machine, away from the milling unit, the method encompassing the following steps:

a) bringing a portion, located closer to the milling tool housing, of the receiving conveying device closer to the machine frame;

b) connecting that portion of the receiving conveying device which is located closer to the milling tool housing to the machine frame and thereby creating a swingable suspension of the receiving conveying device on the machine frame; and c) disengaging a first motion coupling between that portion of the receiving conveying device which is located closer to the milling tool housing and a part of the milling tool housing which is movable relative to the machine frame.

An earth working machine of the species and a method of the species are known from DE 10 2014 011 878 A1. The milling unit, having the milling tool and the milling tool housing that shields the milling tool with respect to the external environment, must occasionally be disengaged and detached from the machine frame. In order to minimize stoppage times of the earth working machine, as a rule another milling unit is installed on the machine frame immediately after detachment of a milling unit.

According to the present Application, the milling unit as a rule is fastened onto the milling-ready earth working machine on the underside of the machine frame, and is located between a front and a rear drive-unit arrangement in a longitudinal direction of the earth working machine. Because the movement space is limited by the drive units in a longitudinal machine direction (parallel to the roll axis) and by the machine frame in a vertical machine direction (parallel to the yaw axis), as a rule the milling unit can be detached from the machine frame, after disengagement from the machine frame, only in a transverse machine direction (parallel to the pitch axis).

A "milling tool housing" for purposes of the present Application has lateral delimiting walls that shield the external environment parallel to the pitch axis with respect to the milling tool. The lateral delimiting walls are also referred to among specialists as "edge protectors." The milling tool housing furthermore comprises a front delimiting wall that precedes the milling tool in a context of forward motion of the earth working machine and shields the external environment in a direction parallel to the roll axis of the milling tool. The front delimiting wall is also referred to among specialists as a "hold-down device." The milling tool housing furthermore comprises a rear delimiting wall that trails behind the milling tool in a context of forward motion of the earth working machine. This rear delimiting wall, also referred to among specialists as a "scraper," again shields the external environment parallel to the roll axis with respect to the milling tool. The shielding directions of the front and rear delimiting walls are opposite to one another. The milling-ready milling tool is located between the front and the rear delimiting wall, and between the lateral delimiting walls.

The problem presented by the subjects of the species (earth working machine and method) is the following:

In many cases, the lateral delimiting walls of the milling tool housing protrude in a longitudinal machine direction beyond the front delimiting wall of the milling tool housing. A longitudinal end of the receiving conveying device which is located closer to the milling unit is located between those portions of the lateral delimiting walls which protrude forward beyond the front delimiting wall. Collision-free detachment of the milling unit from the machine frame is therefore possible only when the lateral delimiting walls and the milling-unit-proximal longitudinal end of the receiving conveying device no longer overlap (when viewed along the pitch axis). The milling-unit-proximal longitudinal end of the receiving conveying device is therefore temporarily moved away from the milling unit toward the front, i.e. in a forward travel direction of the earth working machine.

DE 10 2014 011 878 A1 teaches, for that purpose, firstly to bring that longitudinal end of the receiving conveying device which is closer to the milling unit and is mounted on the front delimiting wall, the front delimiting wall being vertically adjustable via actuator, closer to the machine frame, and then to fasten it swingably on the machine frame and disengage the mounting connection of the longitudinal end to the front delimiting wall. The milling-unit-distal longitudinal end of the receiving conveying device meanwhile remains mounted translationally slidingly on the machine frame.

In accordance with the known method and the known earth working machine, the milling-unit-proximal longitudinal end of the receiving conveying device is deliberately suspended, using obliquely extending connecting means, swingably on the machine frame in such a way that the entire receiving conveying device is preloaded by its weight in a longitudinal machine direction away from the milling unit. If the receiving conveying device is left to move freely, for example after detachment of a securing connecting means that initially secures the milling-unit-proximal longitudinal end in its longitudinal position in a longitudinal machine direction, the milling-unit-proximal longitudinal end pivots on the swingable connecting means, around its suspension point on the machine frame, away from the milling unit. Because it is slidingly mounted, the milling-unit-distal longitudinal end likewise moves in slidingly guided fashion with a motion component that is directed away from the milling unit.

This solution is disadvantageous firstly because the weight-driven pivoting motion of the milling-unit-proximal longitudinal end of the receiving conveying device can be controlled only to a limited extent because of the large mass of the receiving conveying device. A further disadvantage is that, as a function of the oblique orientation of the connecting means, the weight-driven motion drive of the milling-unit-proximal longitudinal end of the receiving conveying device functions in only one direction (as a rule, away from the milling unit), but once a milling unit has again been placed on the machine frame, the milling-unit-proximal longitudinal end must be moved again closer to the milling unit and connected to the front delimiting wall for motion together. This approaching motion of the milling-unit-proximal longitudinal end against the weight of the receiving conveying device either requires additional mechanical effort or an elevated energy expenditure, and/or permits the milling-unit-proximal longitudinal end to be moved only a short distance away from the front delimiting wall.

SUMMARY OF THE INVENTION

The object of the present invention is therefore to simplify, in light of the disadvantages referred to above, temporary distancing of the milling-unit-proximal longitudinal end of the receiving conveying device.

According to an apparatus-related aspect, the present invention achieves this object by way of an earth working machine of the kind recited previously whose receiving conveying device, in addition to swingable suspension on the machine frame, is couplable by means of a second motion coupling, different from the first, to a component arrangement of the earth working machine which is drivable to move relative to the machine frame, in such a way that a driven motion of the component arrangement, from an initial position into a final position different therefrom, brings about a displacement of the receiving conveying device, suspended swingably on the machine frame, away from the milling unit.

According to a method-related aspect, the present invention achieves this object by way of a method of the kind recited previously which additionally encompasses the following method steps:

d) coupling the receiving conveying device, by means of a second motion coupling different from the first, to a component arrangement of the earth working machine which is drivable to move relative to the machine frame, in such a way that a driven motion of the component arrangement, from an initial position into a final position different therefrom, brings about a displacement of the receiving conveying device away from the milling unit; and e) driving the component arrangement to move from the initial position into the final position.

The central idea on which the present invention is based is to use a component arrangement that is drivable to move relative to the machine frame as a switchable motion drive system for the receiving conveying device in order to drive the milling-unit-proximal longitudinal end of the receiving conveying device, after swingable suspension of that portion of the receiving conveying device which is located closer to the milling tool and after disengagement of the first motion coupling of that longitudinal end, to move in controlled fashion away from the milling unit. A weight-driven motion of the milling-unit-proximal longitudinal end, which is only limitedly controllable, can thereby be avoided. A longer motion path away from the milling unit than is possible with the known removal motion driven only by weight is furthermore made possible by the use, as a motion drive system of the receiving conveying device, of the component arrangement that is drivable to move. It is furthermore immaterial whether the first motion coupling becomes disengaged before or after establishment of swingable suspension. This is because the milling-unit-proximal longitudinal end of the receiving conveying device is preferably gripped positively from behind by a portion of that part of the milling tool housing which movable along with it, so that in the event of disengagement of the first motion coupling it cannot drop down even when that portion of the receiving conveying device which is located closer to the milling tool is not yet swingably suspended on the machine frame.

The term "swingable" in connection with suspension of the milling-unit-proximal longitudinal end of the receiving conveying device does not imply here that the swingable suspension actually results in a swinging motion of the milling-unit-proximal longitudinal end. It is sufficient, for "swingable" suspension of the milling-unit-proximal longitudinal end of the receiving conveying device for purposes of the present Application, if the milling-unit-proximal longitudinal end is deflectable in at least one direction around its machine-frame-side suspension point after disengagement of the first motion coupling. Swingable suspension or swingable suspendability can therefore be achieved by a suspension means having a chain portion and/or a cable portion. Alternatively or additionally, the suspension means can also encompass a rod if the latter is pivotably couplable to the machine frame and to the receiving conveying device, on the one hand at its respective suspension points on the machine frame and on the other hand at pivot axes that are parallel to the receiving conveying device and as a rule orthogonal to the longitudinal rod axis. The suspension means having a chain portion and/or cable portion also preferably have, at least at one longitudinal end, preferably at both longitudinal ends, coupling configurations for coupling to the machine frame and/or to the receiving conveying device. A coupling configuration of this kind can be, for example, a hook, in particular a carabiner hook, or an eye.

That part of the milling tool housing which is coupled by means of the first motion coupling for motion together with that portion of the receiving conveying device which is located closer to the milling tool is preferably at least a portion of the front delimiting wall of the milling tool housing. Particularly preferably, the aforesaid portion of the receiving conveying device is coupled to the hold-down device of the milling tool for motion together.

The "hold-down device" is a housing part which terminates the front delimiting wall of the milling tool housing toward the substrate that is to be worked, and which slides floatingly on the substrate portion located in front of the milling tool during milling operation. The hold-down device preferably comprises a slider shoe that has, in a longitudinal machine direction, a considerably greater dimension than those portions of the front delimiting wall which are located farther, in a vertical machine direction, from the substrate being worked. Because milling earth working is usually accomplished as counterdirectional milling, milling bits emerge from the as-yet unworked substrate at the end of milling tool engagement with the substrate. The emergence point is located in front of the milling tool. The risk therefore exists that substrate fragments might spall off or break free in undesirable and uncontrolled fashion. By physically resting on the substrate that is yet to be worked in a region directly in front of the milling tool, the hold-down device prevents substrate fragments from breaking away in this manner in front of the milling tool.

The hold-down device, or in general that part of the milling tool housing which is coupled for motion together with that portion of the receiving conveying device which is located closer to the milling tool, is preferably liftable and lowerable by means of a force device, for example a hydraulic or pneumatic piston-cylinder arrangement or an electric-motor spindle, so that preferably, and without the use of additional actuators, that portion of the receiving conveying device which is located closer to the milling tool housing is brought closer to the machine frame by lifting that part of the milling tool housing which is coupled for motion together.

An "installation state" for purposes of the present Application refers to a non-milling-ready state of the earth working machine in which the first motion coupling is disengaged and that portion of the receiving conveying device which is located closer to the milling tool is suspended swingably on the machine frame.

A portion of the receiving conveying device which is located farther from the milling tool is supported, preferably both in the operating state and in the installation state, with a translational degree of freedom on a preferably machine-frame-mounted bearing, for example supported slidingly on a slide bearing or suspendedly on a suspension bearing. Preferably, a slide cam that is in abutting engagement with a predetermined slide track of the slide bearing protrudes from that portion of the receiving conveying device which is located farther from the milling tool. The slide track defines the relative motion of the sliding cam, and thus of that portion of the receiving conveying device which is located farther from the milling tool, relative to the machine frame. The slide track can be constituted by a flank, and by a groove wall located at a distance oppositely from the flank, of a slide groove. The slide cam can slide in the slide groove and can be prevented by the slide groove from lifting away from the slide track. As a rule, however, the weight of the receiving conveying device is sufficient to prevent lifting, so that preferably the slide cam merely rests on the slide track. Divergently from what is stated above, the slide cam can of course be embodied on the machine frame and the slide track on the receiving conveying device, although this is not preferred because of the different sizes of the installation spaces available on the respective subassemblies (machine frame and receiving conveying device). Advantageously, however, it is sufficient only to modify the bearing situation of the milling-unit-proximal bearing of the receiving conveying device upon transition from the operating state to the installation state and vice versa, while the bearing situation of the milling-unit-distal bearing of the receiving conveying device can remain unchanged.

Particularly preferably, when the earth working machine is standing, as a reference state, on a flat horizontal substrate and is oriented for forward travel, a machine-frame-side suspension point and a conveying-device-side suspension point of a given swingable suspension system are located in a common plane orthogonal to the roll axis of the earth working machine, so that the weight of the receiving conveying device on the swingable suspension system does not produce a motion along the roll axis (in a longitudinal machine direction) away from the milling unit.

Strict orthogonality of the common plane of the aforesaid suspension points is not absolutely necessary given the friction existing between the receiving conveying device and the machine frame. No appreciable weight-driven motion of the conveying-device-side suspension point occurs even if the common arrangement plane of the machine-frame-side suspension point and conveying-device-side suspension point is tilted, with reference to the aforesaid plane that is orthogonal to the roll axis and constitutes a reference plane, by a magnitude of no more than 15°, more preferably no more than 10°, around the pitch axis of the earth working machine.

If a swingable suspension system is implemented using three suspension points—two on one subassembly from among the machine frame and receiving conveying device, and one on the respective other subassembly—the above-described condition for avoiding a weight-driven motion in a longitudinal machine direction away from the milling unit after disengagement of the first motion coupling applies to the angle-bisecting plane between each of the two common planes tilted around the pitch axis with respect to the reference axis, each of which contains another suspension point on the one subassembly and the suspension point on the respective other subassembly. If this angle-bisecting plane is tilted in terms of magnitude by more than 15° around the pitch axis with respect to the reference plane immediately before disengagement of the first motion coupling, it is to be expected that the receiving conveying device will automatically move away from the milling unit, in weight-driven fashion, after disengagement of the first motion coupling. Avoidance of such an automatic motion of the milling-unit-proximal longitudinal end of the receiving conveying device away from the milling unit simplifies a return approaching motion of the milling-unit-proximal longitudinal end toward the milling unit by way of the component arrangement, in order to reestablish the first motion coupling so as to make the earth working machine once again milling-ready.

A motion of the component arrangement from the final position toward the initial position preferably brings about a displacement of the receiving conveying device toward the milling unit. The second motion coupling can be embodied for that purpose in such a way that it can transfer both tensile and thrust forces. Alternatively, the second motion coupling can be embodied in such a way that it can transfer tensile forces in opposite directions, for example by using two pulling means which act in opposite directions and of which only one or the other respectively acts, depending on the motion direction of the component arrangement.

Because of the large mass of the receiving conveying device, however, it is preferred that the receiving conveying device, and with it its milling-unit-proximal longitudinal end, brings about, as a result of its weight, a gravity-induced approach motion toward the milling unit. When the second motion coupling is established, the motion of the component arrangement from the final position back toward the initial position can control or moderate the gravity-induced return motion of the milling-unit-proximal longitudinal end as an obligatory condition.

The second motion coupling can comprise pulling means, for example a tension cable arrangement or a tension chain arrangement, and/or pushing means, for example a pushrod arrangement, couplable both to the receiving conveying device and to the component arrangement in order to transfer forces from the component arrangement to the receiving conveying device.

The second motion coupling preferably encompasses pulling means, particularly preferably exclusively pulling means, since they can be stowed in a particularly small stowage space when not being used. In order to allow the pulling forces transferrable by pulling means to be aligned in directionally appropriate fashion for the desired distancing motion of the milling-unit-proximal longitudinal end of the receiving conveying device, the second motion coupling preferably encompasses, in addition to the pulling means, deflection means that are embodied to deflect the course and the applied force of the pulling means. A deflection means of this kind can encompass at least one deflection roller and/or at least one deflecting slide configuration. A deflecting slide configuration can eliminate an additional, separate deflection component if, advantageously, a configuration already present on the earth working machine is used as a deflecting slide configuration. It can be sufficient for that purpose if the deflecting slide configuration is embodied on a structure that is not movable together with the component arrangement between the initial position and the final position. Such a structure can be, for example, a crossmember, rod, strut, and the like on the earth working machine. The structure having the deflecting slide configuration can be machine-frame-mounted or can be movable between an initial position and final position relative both to the machine frame and to the motion of the component arrangement.

When the second motion coupling is established, the deflection means are arranged in the power flow between the attachment points of the pulling means on the receiving conveying device and the component arrangement, in order to transfer forces from the component arrangement to the receiving conveying device with maximally optimum alignment between those attachment points.

The receiving conveying device is preferably a conveyor belt device having a conveying belt circulating on a conveying-device frame. A first attachment point of the second motion coupling is therefore preferably located on the conveying-device frame, which is rigid compared with the conveying belt. In order to avoid undesired tilting moments around a tilt axis parallel to the conveying direction of the receiving conveying device, a second respective motion coupling is preferably located on each side of the conveying belt, the attachment points of the two second motion couplings on the conveying-device frame preferably, in the reference state as defined above, having a spacing from one another only along the pitch axis but having substantially the same coordinates along the roll axis and along the yaw axis of the earth working machine.

In principle, the receiving conveying device can be the only conveying device on the earth working machine, conveying substrate material, removed by the milling tool during milling operation, away from the milling unit. In order to implement comparatively long and/or non-straight-line conveying sections, according to an advantageous refinement the earth working machine encompasses an ejecting conveying device that follows the receiving conveying device in a conveying direction away from the milling unit. The receiving conveying device then transfers substrate material, removed during milling operation, to the ejecting conveying device for further conveying in a conveying direction. The ejecting conveying device, which is usually embodied to eject the substrate material conveyed to it to a receiving vehicle at its transfer-distal longitudinal end traveling along with the earth working machine, is tiltable, in the reference state defined above, around a tilt axis parallel to the pitch axis in order to adjust substrate material ejection with respect to the receiving vehicle. The component arrangement can encompass the ejecting conveying device, which is in any case arranged physically near the receiving conveying device, in order to bring about, as a result of its relative motion relative to the machine frame in an installation state, a motion of the ejecting conveying device away from the milling unit. A second attachment point of the second motion coupling can then be arranged on the ejecting conveying device. The first attachment point of the second motion coupling is arranged, as described above, on the receiving conveying device. In order to maximize both stability and the forces transferrable via the second motion coupling, in particular pulling forces, the second attachment point is preferably arranged on a frame of the ejecting conveying device.

The ejecting conveying device is preferably likewise a conveyor belt device, having a rigid frame and a conveying belt that is guided circulatingly on the frame.

In addition to tiltability around the tilt axis, the ejecting conveying device can be pivotable around a pivot axis parallel to the yaw axis. The ejecting conveying device is then, as a rule, received on a holding bracket only tiltably around the tilt axis, and is articulated on the machine frame pivotably together with the holding bracket around the pivot axis that is parallel to the yaw axis. Because the motion of the ejecting conveying device between an initial position and final position, in order to bring about a distancing motion of the receiving conveying device away from the milling unit, is preferably a motion around the tilt axis, the holding bracket can comprise the aforementioned deflection means, for example a crossmember that spans the holding bracket parallel to the pitch axis, even though the holding bracket itself is movable relative to the machine frame. It is sufficient for it not to be movable together with the ejecting conveying device in the direction in which the motion of the ejecting conveying device serves to drive the removal motion of the receiving conveying device.

The component arrangement can encompass a component of a drive train of the receiving conveying device or of the ejecting conveying device which follows the receiving conveying device in a conveying direction away from the milling unit. This drive train component can preferably be a drive roller of a conveying belt of one of the aforesaid conveying devices. If the drive train component is a drive train component of the receiving conveying device, the attachment of the second motion coupling to the drive train component is an attachment to the receiving conveying device. If the drive train component of the receiving conveying device is coupled by way of the second motion coupling to the machine frame, or to a component or subassembly of the earth working machine which is movable relative to the receiving conveying device, then by means of the second motion coupling thereby established, the receiving conveying device can be distanced from the milling unit by driving the drive train component, and preferably can be brought back closer to the milling unit by reversing the direction of motion of the drive train component.

If the drive train component is part of a different conveying device, however, for example the ejecting conveying device, the second motion coupling then extends between the receiving conveying device and the drive train component. Once again, the receiving conveying device can be distanced from and moved back toward the milling unit by driving the drive train component and by reversing the motion thereof.

In order to furnish an advance motion for the milling tool, the earth working machine is preferably a self-propelled earth working machine having a drive motor. The component arrangement can then encompass a portion of a propelling unit of the earth working machine with which the earth working machine stands on a substrate that supports it. The first attachment point of the second motion coupling can then, as discussed above, be arranged on the receiving conveying device, and the second attachment point of the second motion coupling can be arranged on a part of the propelling unit which rolls on the substrate during a traveling motion of the earth working machine, for example a drive track or a drive wheel. The milling-unit-proximal longitudinal end of the receiving conveying device can then be distanced from the milling unit by way of a traveling motion in which the rolling propelling-unit part moves relative to the receiving conveying device, and preferably moved back toward it by reversing the direction of travel.

The machine frame is preferably coupled vertically adjustably to the drive unit, a vertical adjustment of the machine frame bringing about the displacement of the receiving conveying device in the installation state. In this case the second attachment point of the second motion coupling can, but need not, be arranged on a rolling part of the propelling unit. The second coupling point of the second motion coupling can instead be arranged on a component that is displaceable together with the propelling unit relative to the machine frame, for example on a lifting column or on a propelling-unit fork rigidly connected to the lifting column or on a propelling-unit axle component that guides the rolling motion of a rolling propelling-unit part. The first attachment point of the second motion coupling is arranged on the receiving conveying device. In order to convert the lifting and lowering motion of the machine frame respectively into a distancing and approaching motion of the milling-unit-proximal longitudinal end of the receiving conveying device, an aforementioned deflection device, for example a machine-frame-mounted crossmember or in general a machine-frame-mounted deflecting slide configuration, is preferably provided between the aforesaid first and second attachment points of the second motion coupling.

Alternatively, the component arrangement can also encompass that part of the milling tool housing to which the receiving conveying device is coupled by the first motion coupling in the operating state, i.e. preferably, for example, to the hold-down device. Coupling the receiving conveying device to the movable milling tool housing part with interposition at least of a deflection means makes it possible to bring about, by way of the relative motion of the milling tool housing part relative to the machine frame, a distancing motion of the receiving conveying device away from the milling unit. An approaching motion toward the milling unit can likewise be brought about by reversing the direction of motion of the milling tool housing part.

It is conceivable in principle to hold the receiving conveying device, using the component arrangement, in a desired position distanced from the milling unit. Because that position may need to be held for a considerable length of time when replacing milling units, however, in order to relieve stress on the component arrangement and/or on the second motion coupling it is advantageous if the receiving conveying device is securable, in its position displaced away from the milling unit, against a returning approaching motion toward the milling unit.

According to a design embodiment, the earth working machine can comprise for that purpose a locking apparatus into whose engagement region a retaining configuration of the receiving conveying device can be brought, in the context of a predetermined distance from the milling unit, in order to establish a positive locking engagement. The retaining configuration of the receiving conveying device can be, for example, one of the aforementioned protruding slide cams that executes, on the preferably machine-frame-side slide track of the slide-bearing pair, a defined motion that is therefore predictable during the distancing motion of the milling-unit-proximal longitudinal end of the receiving conveying device away from the milling unit. The locking apparatus can comprise a stud or a hook that can then be displaced blockingly into the return motion path of the retaining configuration once the retaining configuration has moved past the locking apparatus in its distancing motion path during a distancing of the receiving conveying device from the milling unit. The locking apparatus can thus physically block a return motion of the receiving conveying device.

In simple and safe fashion, since it eliminates any locking actuation by an operator, the locking apparatus can be a latching apparatus for automatically establishing a latching engagement with the retaining configuration when the retaining configuration arrives in a predetermined latching engagement region of the latching apparatus during a distancing motion of the receiving conveying device. For example, the latching apparatus can encompass a hook which is deflectable out of a latching position and which, during a motion of the retaining configuration away from the milling unit, is deflectable away from the retaining configuration out of a latching position into which it is preloaded, and which is not deflectable in an opposite direction during a motion of the retaining configuration. For example, the hook can comprise a runup bevel with which the retaining configuration comes into abutment during a motion away from the milling unit and which, as the motion continues, moves the hook against its preload out of the latching position by means of the abutting engagement. Once the retaining configuration has moved past a holding configuration of the hook which follows the runup bevel in the direction of the distancing motion, the hook is moved by its preload back into the latching position, where it prevents the retaining configuration, and thus the receiving conveying device as a whole, from moving toward the milling unit. The hook must then be moved out of the latching position, by an actuator or manually by an operator, in order to enable the receiving conveying device to move back closer to the milling unit.

The retaining configuration can of course also be embodied on the machine frame, and the locking system or locking apparatus can be embodied on the receiving conveying device, although this is not preferred.

Very generally, the method for temporarily distancing the receiving conveying device from the milling unit can therefore encompass the following further step:

f) securing the receiving conveying device in a position in which the receiving conveying device is arranged with a greater spacing from the milling unit than in an operationally ready state of the earth working machine.

The milling tool is preferably a milling drum that carries, on its outer side, milling bits held replaceably in bit holders. For easier replacement of worn-out milling bits, the bit holders are preferably quick-change bit holders. The milling drum is preferably rotatable during milling operation, preferably counterdirectionally, around a milling-drum axis that proceeds parallel to the pitch axis. The milling tool housing is therefore preferably a milling drum housing.

BRIEF DESCRIPTION OF THE DRAWINGS

The present invention will be explained in further detail below with reference to the attached Figures, in which.

DETAILED DESCRIPTION

Figure 1:
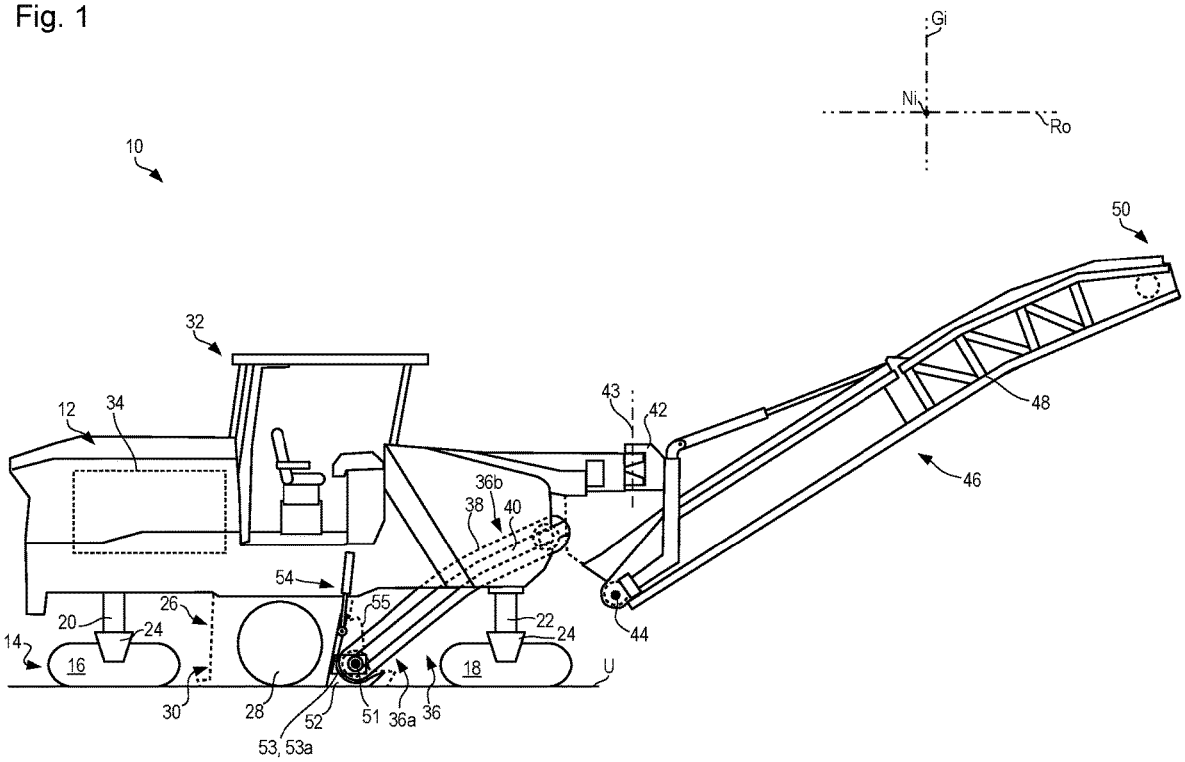
FIG. 1 is a schematic side view of an embodiment according to the present invention of an earth working machine in the form of a large road milling machine, in the milling-ready state.

In FIG. 1, an embodiment according to the present invention of an earth working machine is labeled in general with the number 10. In the example depicted, earth working machine 10 is a road milling machine, more precisely a large road milling machine 10. It encompasses a machine frame 12 that is carried vertically adjustably on a propelling unit 14. Propelling unit 14 encompasses at least one, as a rule two rear drive units 16, and at least one, as a rule two front drive units 18. In the instance depicted, drive units 16 and 18 are crawler track units. Divergently therefrom, one or several of drive units 16 and 18 can be wheel drive units. Road milling machine 10 stands with propelling unit 14 on a substrate U that, in the present example, is a flat, horizontal reference substrate.

Rear drive units 16 are each connected by a rear lifting column 20, and front drive units 18 each by a front lifting column 22, to machine frame 12. Lifting columns 20 and 22 are each connected to the respective drive units 16 and 18 via a propelling-unit fork 24. Drive units 16 and 18 are received in their respective propelling-unit fork 24 pivotably around a pivot axis parallel to pitch axis Ni. The clearance of machine frame 12 above substrate U parallel to yaw axis Gi in the region of rear drive units 16 can be increased by extending lifting columns 20, and analogously increased in the region of front drive units 18 by extending lifting columns 22. A retraction of lifting columns 20 and/or 22 correspondingly decreases the clearance of machine frame 12 above substrate U in the region of the respective drive units 16 and/or 18.

A replaceable milling unit 26, which encompasses a milling drum 28 constituting a milling tool and a milling drum housing 30 that shields the milling drum with respect to the external environment, is arranged on the underside of machine frame 12 and fixedly attached onto machine frame 12 for motion together therewith. Parts of milling drum housing 30 are movable, in particular liftable and lowerable, relative to machine frame 12, for example so that, during milling operation of road milling machine 10, walls or wall portions of the milling drum housing can slide floatingly on substrate U or so that walls or wall portions can be deliberately lifted and lowered again via actuator in order to avoid collisions with oncoming substrate configurations. In the interest of clarity, milling drum housing 30 is depicted merely with dashed lines.

During milling operation and for maintenance, milling drum 28 is rotatable around a rotation axis (not depicted) that is parallel to pitch axis Ni. In the example depicted, milling drum 28 is translationally immovable relative to machine frame 12. In the example depicted, the milling depth is therefore adjusted by way of lifting columns 20 and 22, and by adjusting the height of the machine frame above substrate U. Divergently therefrom, milling drum 28 can also be received vertically adjustably on machine frame 12.

The operation of road milling machine 10 can be controlled from an operating cabin or operator's platform 32 that is located, in the example depicted, above milling unit 26.

A motor 34 in the rear part of machine frame 12 supplies the drive power both for advancing road milling machine 10 via propelling unit 14 and for milling drum 28, and if desired also for further actuators of road milling machine 10. Motor 34 is an internal combustion engine whose mechanical output is converted in part into hydraulic energy, and that energy is furnished to various locations in road milling machine 10 for use as drive energy.

A receiving conveying device 36, in the form of a conveyor-belt device having a recirculating belt 38, is located in front of milling drum 28, i.e. closer to the front side of road milling machine 10. The receiving conveying device 36 may also be referred to as a receiving conveyor 36. A frame 40 of receiving conveying device 36 supports belt 38 and its guidance and drive rollers (not depicted in detail). Only the end-located deflection rollers of belt 38, which are mounted on frame 40, are indicated with dashed lines.

At the front longitudinal end of machine frame 12, a holding bracket 42 is connected to machine frame 12 pivotably around a pivot axis 43 parallel to yaw axis Gi. An ejection conveying device 46, which is tiltable relative to holding bracket 42 around a tilt axis 44 parallel to pitch axis Ni, is connected in turn to holding bracket 42. Ejection conveying device 46 is also a conveyor-belt device having a recirculating belt (not depicted) and having a frame 48 that guides and supports the belt. The end-located deflection rollers of the belt, which are mounted rotatably on frame 48, are indicated with dashed lines. The ejection conveying device 46 may also be referred to as an ejection conveyor 46.

During milling operation, a portion 36*a* of receiving conveying device 36 which is located closer to milling drum 28 picks up substrate material of substrate U which has been removed as intended by the milling drum, and conveys it away from milling drum 28 toward ejection conveying device 46. In the region of its milling-unit-distal longitudinal end, receiving conveying device 36 transfers the removed substrate material to ejection conveying device 46, which conveys it farther away from milling unit 26 and ejects it at its machine-frame-distal longitudinal end 50, in a manner known per se, for example onto a receiving vehicle that is traveling along with road milling machine 10.

Receiving conveying device 36 is connected at its longitudinal end located closer to milling drum 28, via a first motion coupling 53 and pivotably around a compensation axis 51 parallel to pitch axis Ni, to a hold-down device 52 on milling drum housing 30. As in the present instance, first motion coupling 53 can be a pair of bearing arms 53*a* that hold the milling-unit-proximal longitudinal end of receiving conveying device 36 between them.

Hold-down device 52 in turn is movable, i.e. liftable and lowerable parallel to yaw axis Gi relative to machine frame 12, by way of an actuator 54, for example a hydraulic or pneumatic piston-cylinder arrangement or an electric-motor actuator. The hold-down device can be guided for a lifting and lowering motion in such a way that during the lifting motion it additionally executes a pivoting motion in a first pivoting direction around a pivot axis parallel to the pitch axis, and during the lowering motion it executes a pivoting motion in a second pivoting direction opposite to the first. Because first motion coupling 53 between hold-down device 52 and receiving conveying device 36 permits only a pivoting motion around compensation axis 51 as the sole relative-motion degree of freedom between receiving conveying device 36 and hold-down device 52, that longitudinal end of receiving conveying device 36 which is located closer to milling drum 28 moves together with hold-down device 52, parallel to yaw axis Gi, upon lifting and lowering of said device. Because of the relative-motion degree of freedom just described, receiving conveying device 36 does not participate in any pivoting motion of hold-down device 52 parallel to the pitch axis while the latter is being lifted or lowered. A portion 36*b* of receiving conveying device 36 which is located farther from milling drum 28 is guided on a slide bearing translationally with a motion component in the direction of roll axis Ro, optionally also with a motion component in the direction of yaw axis Gi. The slide bearing is usually machine-frame-mounted.

As is apparent from FIG. 1, lateral delimiting walls 55 of milling drum housing 30 protrude forward beyond hold-down device 52, so that when road milling machine 10 is in the milling-ready state, the milling-drum-proximal end of receiving conveying device 36 is located between solid wall portions of lateral delimiting walls 55 of milling drum housing 30.

Because of the location of drive units 16 and 18, once milling unit 26 has been disengaged from machine frame 12 it can be distanced from the remainder of road milling machine 10 only in a lateral machine direction, i.e. parallel to pitch axis Ni. A distancing motion of this kind is opposed, however, by the aforementioned overlap of lateral delimiting walls 55 of milling drum housing 30 and the milling-unit-proximal longitudinal end of receiving conveying device 36.

This collision risk, which interferes with replacement of milling unit 26, can advantageously be eliminated as described below:

Hold-down device 52, and together with it the milling-unit-proximal longitudinal end of receiving conveying device 36, are lifted and thereby moved closer to machine frame 12 using actuator 54. In a state brought sufficiently close, portion 36*a* of receiving conveying device 36 which is located closer to milling drum 28 is suspended swingably on machine frame 12 by means of a connecting configuration 57 encompassing a cable arrangement, a chain arrangement, or a rod. A swingable suspension system 56 of this kind is shown in FIG. 2.

Figure 2:
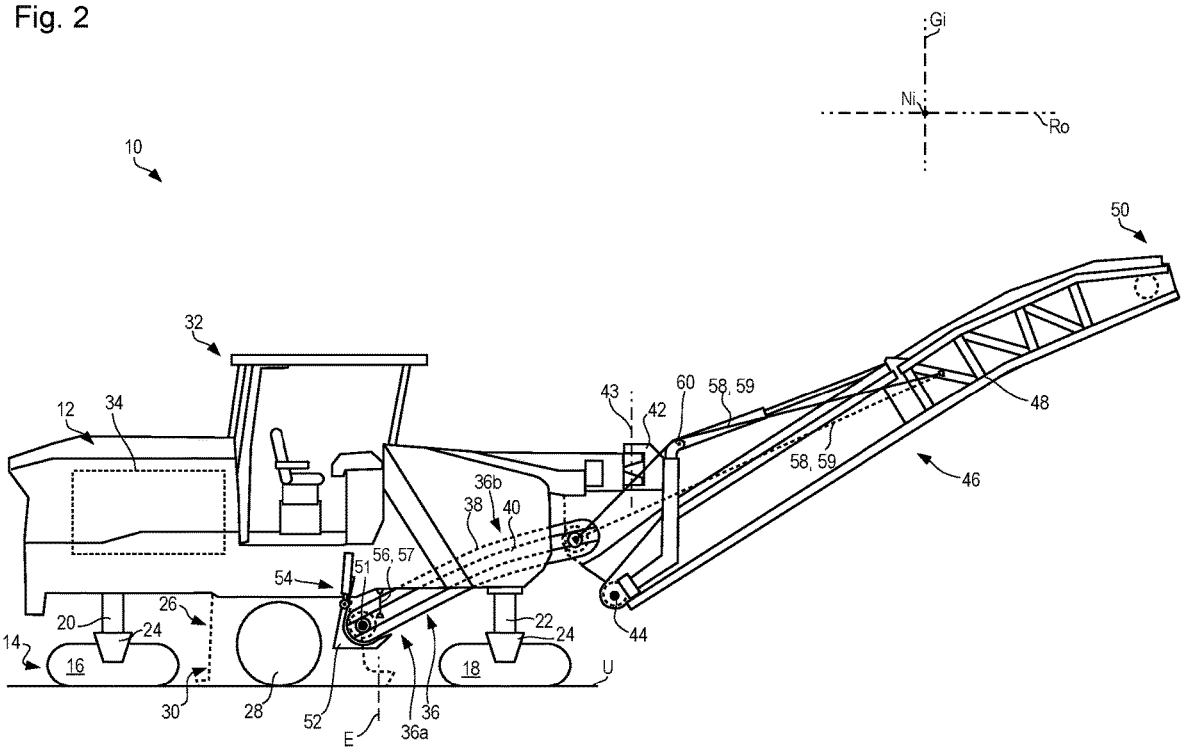
FIG. 2 is a schematic side view of the road milling machine of FIG. 1 with the receiving conveying device in the installation state, with the first motion coupling disengaged and the second one established.

In addition, receiving conveying device 36 is coupled, by means of a second motion coupling 58 that once again can encompass a connecting means 59 having a cable arrangement, chain arrangement, or rod, to a component arrangement that is drivable to move relative to machine frame 12, in the example of FIG. 2 to ejection conveying device 46. The cable arrangement or the chain arrangement may be referred to as a flexible tension member.

Once swingable suspension has been established, and once second motion coupling 58 has been established, first motion coupling 53 to hold-down device 52 becomes disengaged so that hold-down device 52 is movable independently of receiving conveying device 36. This situation is shown in FIG. 2. The disengaged first motion coupling 53 is no longer depicted.

Motion coupling 58 can be guided by way of a deflection device, for example a crossmember 60 of holding bracket 42. The deflection device may also be referred to as a deflector. Because of the relative location of the two conveying devices 36 and 46 with respect to one another, and because of the relative kinematics of ejection conveying device 46 relative to machine frame 12 and relative to receiving conveying device 36, second motion coupling 58 can alternatively also be coupled, without deflection devices, directly between the two conveying devices 36 and 46, as indicated in FIG. 2 with dashed lines.

The machine-frame-side attachment location, and the attachment location of swingable suspension system 56 located on receiving conveying device 36, preferably lie in a plane E that is orthogonal to roll axis Ro when first motion coupling 53 is disengaged (this applies to a reference state depicted in the Figures, with a flat and horizontal substrate U). The result is that after the disengagement of first motion coupling 53, the weight of receiving conveying device 36 cannot initiate a motion of receiving conveying device 36 parallel to roll axis Ro. As a result of friction effects between the remaining support point of receiving conveying device 36 in its portion 36*b* which is located farther from milling drum 28, and unlike what is depicted in the Figures, plane E can be slightly tilted around pitch axis Ni, relative to the plane E which is depicted as orthogonal to the roll axis, without thereby resulting in a displacement of receiving conveying device 36 in a longitudinal machine direction, i.e. parallel to roll axis Ro, after first motion coupling 53 is disengaged. A gravity-driven motion of receiving conveying device 36 away from milling unit 26 should especially be avoided, since it complicates a return motion of receiving conveying device 36 back toward the milling unit, and thus reestablishment of first motion coupling 53.

Figure 3:
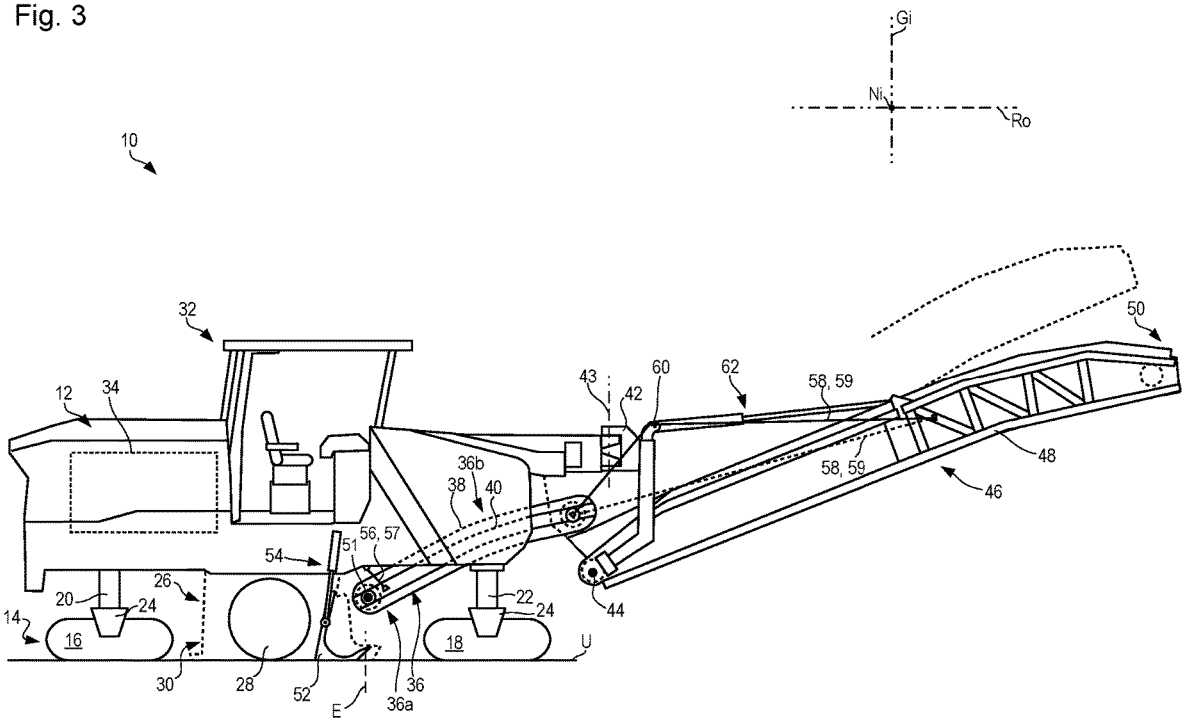
FIG. 3 is a schematic side view of the road milling machine of FIG. 2, with a receiving conveying device distanced from the milling drum housing toward the front of the milling machine.

FIG. 3 shows a position of road milling machine 10 with ejection conveying device 46 lowered around tilt axis 44 as compared with the position of FIG. 2. Ejection conveying device 46 is tiltable relative to holding bracket 42 by way of a tilt actuator 62, for example a hydraulic piston-cylinder arrangement. For comparison, the original position of ejection conveying device 46 is indicated in outline with dashed lines.

The attachment point of second motion coupling 58 on ejection conveying device 46 has been moved by means of the lowering motion around tilt axis 44 from the initial position of ejection conveying device 46 shown in FIG. 2, along a circular path around pivot axis 44, into the final position of ejection conveying device 46 shown in FIG. 3. As a result of this partial-circle motion, the aforesaid attachment point of second motion coupling 58 has executed a motion, having a component parallel to roll axis Ro, away from the installation point of milling unit 26. Either via crossmember 60 constituting a deflecting slide configuration, or by direct connection to receiving conveying device 36, receiving conveying device 36 has been pulled, by the lowering motion of ejection conveying device 46, out of the position shown in FIG. 2 in a direction away from milling unit 26 toward the front side of road milling machine 10. The motion executed by that portion 36*a* of receiving conveying device 36 which is located closer to milling drum 28 is also apparent in FIG. 3 from the deflection of swingable suspension system 56 out of plane E.

Portion 36*a* of receiving conveying device 36 now no longer overlaps lateral delimiting walls 55 of milling drum housing 30 in a direction along roll axis Ro, so that milling unit 26 can now be moved away from machine frame 12, or away from the remainder of road milling machine 10, parallel to pitch axis Ni In its position pulled away from milling unit 26 as shown in FIG. 3, second motion coupling 58 can hold receiving conveying device 36 under tension, or receiving conveying device 36 is held positively in that position by a locking means, preferably a latching means. Mechanical loads on second motion coupling 58, and on ejection conveying device 46 coupled to it, can thereby be relieved. A self-latching locking means of this kind is shown schematically in FIG. 6 and explained in more detail below.

Figure 4:
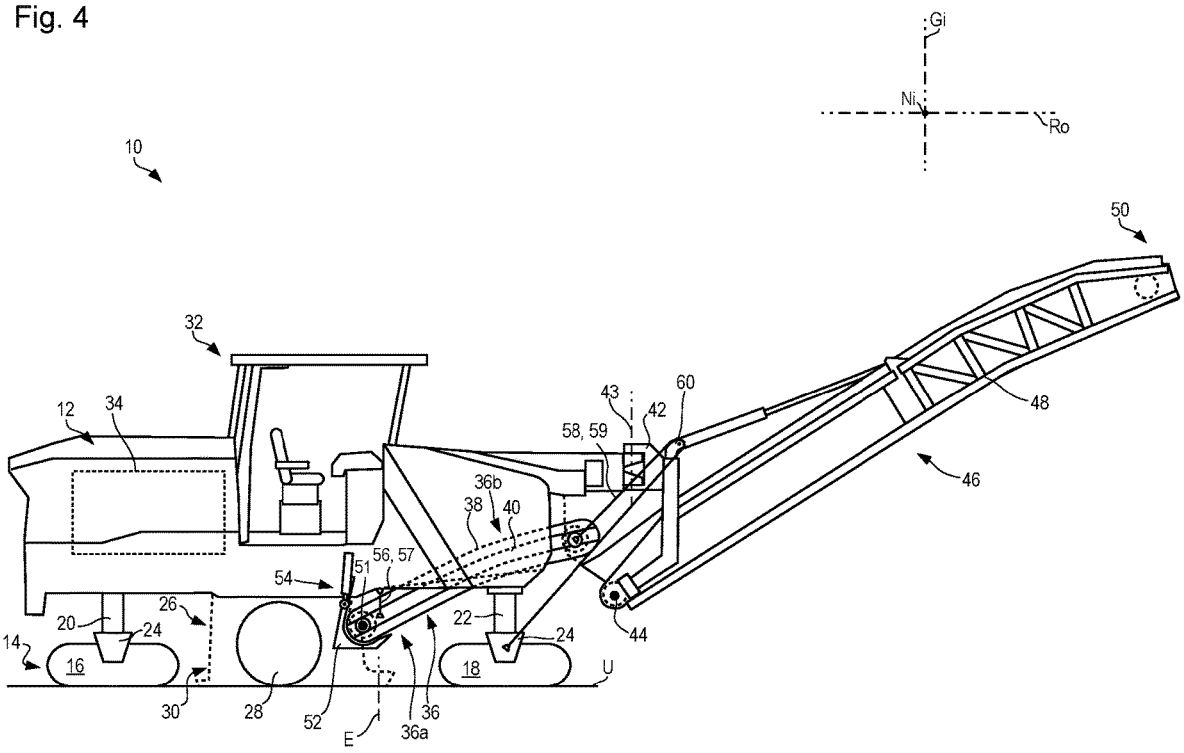
FIG. 4 is a schematic side view of the road milling machine of FIG. 1 with the receiving conveying device in the installation state, with the first motion coupling disengaged and the alternative second one established.

FIG. 4 shows road milling machine 10 in substantially the same position and the same state as in FIG. 2, the only difference being that second motion coupling 58, or its connecting means 59 at its longitudinal end located remotely from receiving conveying device 36, is articulated not on ejection conveying device 46 constituting a component arrangement that is movable relative to machine frame 12 and relative to ejection conveying device 36, but instead on at least one propelling-unit fork 24 of front drive units 18 of propelling unit 14. Thanks to the vertical adjustability of machine frame 12 relative to drive units 16 and 18, and the powerful drive system available for that purpose, the vertical adjustment of machine frame 12 can also be used to drive a displacement motion of receiving conveying device 36 in a longitudinal machine direction away from milling unit 26.

Figure 5:
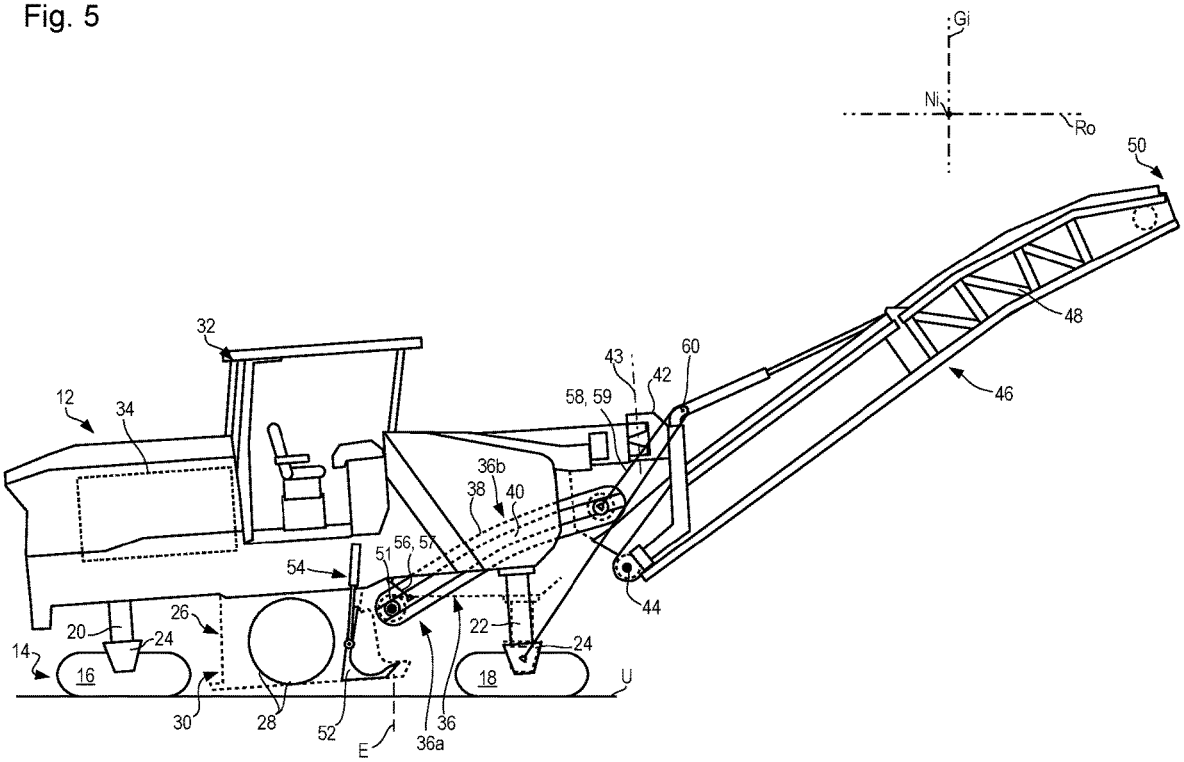
FIG. 5 is a schematic side view of the road milling machine of FIG. 4 with the receiving conveying device distanced from the milling drum housing toward the front side of the milling machine.

FIG. 5 shows road milling machine 10 displaced, by extending front lifting columns 22 and thus by lifting machine frame 12 above front drive units 18, from the initial position of FIG. 4 into a final position.

The vertical adjustment of machine frame 12 relative to front drive units 18 has in turn been transferred to receiving conveying device 36 by connecting means 59 of second motion coupling 58 which are guided via crossmember 60 of holding bracket 42 constituting a deflecting slide configuration, and has thereby displaced said device away from milling unit 26 in a longitudinal machine direction, out of its original position with first motion coupling 53 established. The initial position of road milling machine 10, this time with reference to the underside of machine frame 12, is again shown with dashed lines in FIG. 5 in order to illustrate the change in the position of road milling machine 10.

In FIG. 5 as well, ejection conveying device 36 is sufficiently distanced from milling unit 26 in a longitudinal machine direction that milling unit 26 can be moved in collision-free fashion away from machine frame 12 in a direction parallel to pitch axis Ni.

It is readily apparent that further component arrangements that are drivable to move relative to receiving conveying device 36 are usable as a drive source for displacing receiving conveying device 36 away from milling unit 26. For example, hold-down device 52 that is liftable and lowerable by means of actuator 54 can also be used as such a component arrangement.

Figure 6:
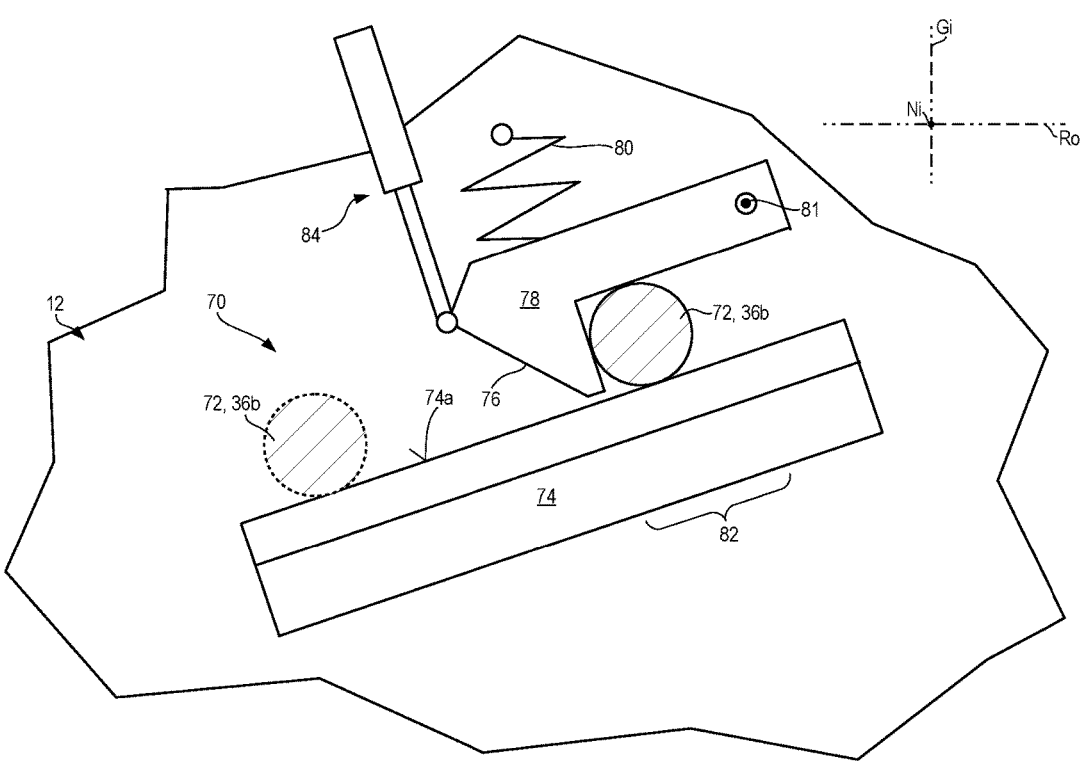
FIG. 6 is a schematic side view of a slide bearing system of a portion of the receiving conveying device which is located farther from the milling tool, having a locking apparatus for securing the portion of the receiving conveying device in position.

FIG. 6 schematically depicts slide bearing 70 of portion 36*b* of receiving conveying device 36 which is located farther from milling drum 28.

A bearing cam 72 of portion 36*b* rests on bearing surface 74*a*, orthogonal to the drawing plane of FIG. 6, of a bearing protrusion 74 on machine frame 12. The direction of gravity is parallel to yaw axis Gi. Bearing surface 74*a* is tilted with reference to substrate U, specifically along the roll axis in a direction away from milling unit 26.

Bearing cam 72 is shown in a position, farther to the left and farther down in FIG. 6, which bearing cam 72 assumes when road milling machine 10 is milling-ready.

Bearing cam 72 is drawn with a solid line in a position farther to the right and farther up in FIG. 6 as compared with its milling-ready position. Bearing cam 72 occupies this position, drawn with a solid line, in the states of road milling machine 10 shown in FIGS. 3 and 5, when receiving conveying device 36 has been distanced from the milling unit by second motion coupling 58, as described above.

In the course of the motion of bearing cam 72 along bearing surface 74*a* from the position drawn with a dashed line to the position drawn with a solid line in FIG. 6, bearing cam 72 moves a latching hook 78 around rotation axis 81, via a runup bevel 76 and against the preload of a spring 80, out of the latched position which is shown in FIG. 6 and which latching hook 78, driven by spring 80, assumes again when bearing cam 72 reaches engagement region 82 of latching hook 78.

In the opposite motion direction of bearing cam 72, latching hook 78 is not automatically movable out of its latched position by the motion of the cam. Provided for that purpose is a release actuator 84 that lifts latching hook 78 around its rotation 81 axis sufficiently that bearing cam 72 can slide back into the milling-ready position. Receiving conveying device 36 can thus be secured, in its position distanced from milling unit 26, until work required in the region of milling unit 26, for example a replacement of milling unit 26, has been completed, and receiving conveying device 36 is to be brought back toward milling unit 36 by reversing the motions of second motion coupling 58 which are described above, in order to reestablish first motion coupling 53.

The invention claimed is:

1. An earth working machine, comprising:

a machine frame;

a milling unit carried on the machine frame and including a milling tool and a milling tool housing configured to shield the milling tool with respect to an external environment of the earth working machine; and a receiving conveyor configured to convey earth material, removed by the milling tool, away from the milling unit;

the receiving conveyor, both in an operationally ready operating state and in a non-operationally-ready installation state, being mounted on the earth working machine movably relative to the machine frame;

such that in the operating state of the receiving conveyor, a portion of the receiving conveyor located closer to the milling tool is coupled by a first motion coupling with a part of the milling tool housing movable relative to the machine frame, the receiving conveyor and the part of the milling tool housing being movable together;

such that in order to establish the installation state, the first motion coupling is disengageable, and the portion of the receiving conveyor located closer to the milling tool is swingably suspendable on the machine frame;

wherein the receiving conveyor, in addition to swingable suspension on the machine frame, is couplable by a second motion coupling, different from the first motion coupling, to a component arrangement of the earth working machine which is drivable to move relative to the machine frame, in such a way that a driven motion of the component arrangement, from an initial position into a final position different from the initial position, brings about a displacement of the swingably suspended receiving conveyor away from the milling unit.

2. The earth working machine according to claim 1, wherein:

a motion of the component arrangement from the final position into the initial position brings about a gravity induced displacement of the receiving conveyor toward the milling unit as a result of a weight of the receiving conveyor.

3. The earth working machine according to claim 1, wherein:

the second motion coupling includes a flexible tension member couplable both to the receiving conveyor and to the component arrangement.

4. The earth working machine according to claim 3, wherein:

the second motion coupling further includes a deflector configured to deflect a course and an applied force of the flexible tension member.

5. The earth working machine according to claim 4, wherein:

the deflector includes at least one deflection roller.

6. The earth working machine according to claim 4, wherein:

the deflector includes at least one deflecting slide configuration mounted on the machine frame so that the deflecting slide configuration does not move with the component arrangement between the initial position and the final position.

7. The earth working machine according to claim 1, wherein:

the second motion coupling includes a pushrod arrangement couplable both to the receiving conveyor and to the component arrangement.

8. The earth working machine according to claim 1, wherein:

the component arrangement includes an ejection conveyor following the receiving conveyor in a conveying direction away from the milling unit, the ejection conveyor being configured such that substrate material from the receiving conveyor is transferred onto the ejection conveyor for further conveyance in the conveying direction.

9. The earth working machine according to claim 8, wherein:

the component arrangement includes a component of a drive train of the receiving conveyor or of the ejection conveyor.

10. The earth working machine according to claim 9, wherein:

the component of the drive train is a drive roller of the receiving conveyor or of the ejection conveyor.

11. The earth working machine according to claim 1, wherein:

the earth working machine is a self-propelled earth working machine including a drive motor and including a propelling unit supporting the earth working machine on a substrate; and the component arrangement comprises a portion of a propelling unit.

12. The earth working machine according to claim 11, wherein:

the machine frame is coupled vertically adjustably to the propelling unit, and the driven motion of the component arrangement includes a vertical adjustment of the machine frame bringing about the displacement of the swingably suspended receiving conveyor to the installation state.

13. The earth working machine according to claim 1, wherein:

the component arrangement includes the part of the milling tool housing to which the receiving conveyor is coupled by the first motion coupling in the operating state.

14. The earth working machine according to claim 13, wherein:

the part of the milling tool housing includes a front wall of the milling tool housing or a hold-down device located forward of the milling tool.

15. The earth working machine according to claim 1, wherein:

the receiving conveyor is securable in a position displaced away from the milling unit against a returning approaching motion toward the milling unit.

16. The earth working machine according to claim 1, further comprising:

a locking apparatus including an engagement region; and the receiving conveyor including a retaining configuration configured to be brought into the engagement region upon movement of the receiving conveyor a predetermined distance from the milling unit, in order to establish a positive locking engagement of the retaining configuration in the engagement region.

17. The earth working machine according to claim 16, wherein:

the locking apparatus is a latching apparatus configured to automatically establish a latching engagement with the retaining configuration when the retaining configuration arrives in the latching engagement region of the latching apparatus during movement of the receiving conveyor away from the milling unit.

18. A method for temporarily distancing a receiving conveyor from a milling unit, the milling unit including a milling tool and a milling tool housing shielding the milling tool, of a substrate-removing earth working machine including a machine frame, the receiving conveyor being in a milling-ready state at a beginning of the method, the receiving conveyor conveying substrate material removed during milling operation of the earth working machine away from the milling unit, the method comprising steps of:

a) bringing a portion, located closer to the milling tool housing, of the receiving conveyor closer to the machine frame;

b) connecting the portion of the receiving conveyor located closer to the milling tool housing to the machine frame and thereby creating a swingable suspension of the receiving conveyor on the machine frame;

c) disengaging a first motion coupling between the portion of the receiving conveyor located closer to the milling tool housing and a part of the milling tool housing movable relative to the machine frame;

d) coupling the receiving conveyor, with a second motion coupling different from the first motion coupling, to a component arrangement of the earth working machine, the component arrangement being drivable to move relative to the machine frame such that a driven motion of the component arrangement from an initial position into a final position different from the initial position brings about a displacement of the receiving conveyor away from the milling unit; and e) driving the component arrangement to move from the initial position into the final position.

19. The method according to claim 18, further comprising:

f) securing the receiving conveyor in a position in which the receiving conveyor is arranged with a greater spacing from the milling unit than in the milling-ready state of the receiving conveyor.

20. The method according to claim 18, wherein:

in step d) the component arrangement includes an ejection conveyor following the receiving conveyor in a conveying direction away from the milling unit, and the second motion coupling includes a flexible tension member connected to the receiving conveyor and to the ejection conveyor; and in step e) the ejection conveyor is pivoted relative to the machine frame to pull the flexible tension member and to pull the receiving conveyor away from the milling unit.

21. The method according to claim 20, wherein:

in step d) the flexible tension member extends across at least one deflection roller.

22. The method according to claim 18, wherein:

in step d) the receiving conveyor engages a deflecting slide fixed relative to the machine frame; and in step e) the receiving conveyor slides on the deflecting slide as the component arrangement is moved between the initial position and the final position.

23. The method according to claim 22, wherein:

in step d) the receiving conveyor includes a retainer and the deflecting slide includes a latch; and further comprising:

latching the retainer to the latch to releasably retain the receiving conveyor in a position corresponding to the final position of the component arrangement.

24. The method according to claim 18, wherein:

in step d) the component arrangement includes a lifting column supporting the machine frame from a propelling unit of the earth working machine, and the second motion coupling includes a flexible tension member connected to the receiving conveyor and to the lifting column or the propelling unit; and in step e) the lifting column is extended relative to the machine frame to pull the flexible tension member and to pull the receiving conveyor away from the milling unit.

25. The method according to claim 18, further comprising:

driving the component arrangement to move from the final position toward the initial position and thereby bringing about a gravity induced displacement of the receiving conveyor toward the milling unit as a result of a weight of the receiving conveyor.

* * * * *